US007841138B1

(12) United States Patent
Frey

(10) Patent No.: US 7,841,138 B1
(45) Date of Patent: Nov. 30, 2010

(54) PLASTIC PANELING ON METALLIC DOOR FRAME

(75) Inventor: John R. Frey, Riverside, CA (US)

(73) Assignee: International Aluminum Corporation, Monterey Park, CA (US)

( * ) Notice: Subject to any disclaimer, the term of this patent is extended or adjusted under 35 U.S.C. 154(b) by 1230 days.

(21) Appl. No.: 10/983,185

(22) Filed: Nov. 8, 2004

(51) Int. Cl.
*E06B 9/00* (2006.01)
*E06B 9/02* (2006.01)

(52) U.S. Cl. ..... 52/204.5; 52/204.1; 52/784.1; 52/799.1; 52/800.1

(58) Field of Classification Search ..... 52/204.1, 52/204.5, 783.1, 784.1, 784.12, 784.13, 790.1, 52/792.1, 797.1, 798.1, 799.1, 800.1, 800.11, 52/800.12, 800.16, 800.18, 784.11, 210
See application file for complete search history.

(56) References Cited

U.S. PATENT DOCUMENTS

| | | | | | |
|---|---|---|---|---|---|
| 435,313 | A * | 8/1890 | Lohse | 52/455 |
| 682,322 | A * | 9/1901 | Cronin | 52/455 |
| 1,694,522 | A * | 12/1928 | Victor | 52/784.1 |
| 1,857,076 | A * | 5/1932 | Zenker | 52/784.1 |
| 1,863,723 | A * | 6/1932 | Levene | 52/464 |
| 2,070,219 | A * | 2/1937 | Tracy | 52/784.1 |
| 2,267,572 | A * | 12/1941 | Moynahan | 52/800.16 |
| 2,694,236 | A * | 11/1954 | Sylvan | 52/784.16 |
| 2,791,809 | A * | 5/1957 | Lincoln, Jr. | 49/501 |
| 2,827,670 | A * | 3/1958 | Schwindt | 52/784.14 |
| 2,918,708 | A * | 12/1959 | Sharp et al. | 52/656.3 |
| 2,951,565 | A * | 9/1960 | Bertil | 52/800.14 |
| 3,198,297 | A * | 8/1965 | Halle | 49/504 |
| 3,530,618 | A * | 9/1970 | Grossman | 49/501 |
| 4,624,091 | A * | 11/1986 | Biro | 52/656.5 |
| 4,689,933 | A * | 9/1987 | Biro | 52/656.5 |
| 4,896,471 | A * | 1/1990 | Turner | 52/455 |
| 5,261,203 | A * | 11/1993 | Yoon | 52/455 |
| 5,557,899 | A * | 9/1996 | Dube et al. | 52/455 |
| 5,713,167 | A * | 2/1998 | Durham et al. | 52/204.54 |
| 5,853,512 | A * | 12/1998 | McKinney | 156/78 |
| 6,311,454 | B1 * | 11/2001 | Kempel | 52/784.15 |
| 6,327,826 | B1 * | 12/2001 | Mann | 52/204.1 |
| 6,378,253 | B1 * | 4/2002 | Richardson | 52/204.5 |
| 6,619,005 | B1 * | 9/2003 | Chen | 52/455 |
| 2004/0074207 | A1 * | 4/2004 | Yao et al. | 52/784.1 |
| 2006/0254164 | A1 * | 11/2006 | Ueda et al. | 52/232 |

* cited by examiner

*Primary Examiner*—Phi Dieu Tran A
(74) *Attorney, Agent, or Firm*—William W. Haefliger

(57) ABSTRACT

A door structure, comprising a metallic door frame, having opposite sides, plastic paneling received on the frame in covering relation with at least one of the sides, the plastic paneling including paneling sections having abutting edges.

18 Claims, 7 Drawing Sheets

60
65
68
63
50
62
66
61
51
67
64
5
16a
18
17a
69
22
23
70
14
13a
12a
11
135
120
26
12
13
27
16
17
12a
13a
20
10
15
17b
15a
19
24
16c
16d
17d
17c
28
29a
29
5

29
29b
48
37d
36d
37c
36c
37a
36a
38
10
34a
34
31
33a
47
46
32
33
36
37
40
35
32a
37b
35a
42
53
39
43
78
36b
76
73
75
81
52
80
72
77
79
74

PLASTIC PANELING ON METALLIC DOOR FRAME

BACKGROUND OF THE INVENTION

This invention relates generally to the fabrication of door structure that includes relatively thin plastic paneling; and more particularly is concerned with reinforcing such plastic panel door structure to block or prevent unwanted sagging or other deformation of the door structure that can occur over time as a consequence of temperature changes and imposed weight.

It is found that such deformation or sagging is a serious problem. It can result in misfit of the door in its frame as during door closing, and weakening of the overall door, including interfit of assembled rail and stile plastic components. There is need for a way to prevent such deformation and sagging using lightweight internal means concealed by or covered by plastic paneling.

SUMMARY OF THE INVENTION

It is a major object of the invention to provide a solution to the above described need. Basically, the invention comprises:

a) a metallic door frame, having opposite sides, b) plastic paneling received on the frame in covering relation with at least one of said sides, c) said plastic paneling typically including paneling sections having abutting edges.

As will be seen, the paneling may include PVC rail and stile door components, as for example two spaced apart stile components extending vertically, and at least one rail component having edges that abut edges of the stile components. The metallic frame may also then include rail and stile components concealed by or covered by the respective plastic rail and stile components.

Another object includes provision of plastic paneling stile components defined by first extrusions slidably received on the metal frame stile components. Further, the plastic paneling rail component may be defined by second extrusions received on the metal frame rail component. Such reception may typically be endwise slidable reception.

A further object includes providing the slide on second extrusion with opposite end edges extending in abutting relation to lengthwise elongated edges of the first extrusions.

Yet another object is to provide the plastic panel abutting edges in the form of interfitting tongue and groove elements, or edge overlapping elements.

An additional object is to provide fasteners acting to hold the second plastic extrusion in edge abutting relation to the first plastic extrusions, by interconnecting metal frame structures.

These and other objects and advantages of the invention, as well as the details of an illustrative embodiment, will be more fully understood from the following specification and drawings, in which:

DRAWING DESCRIPTION

Figure 2:
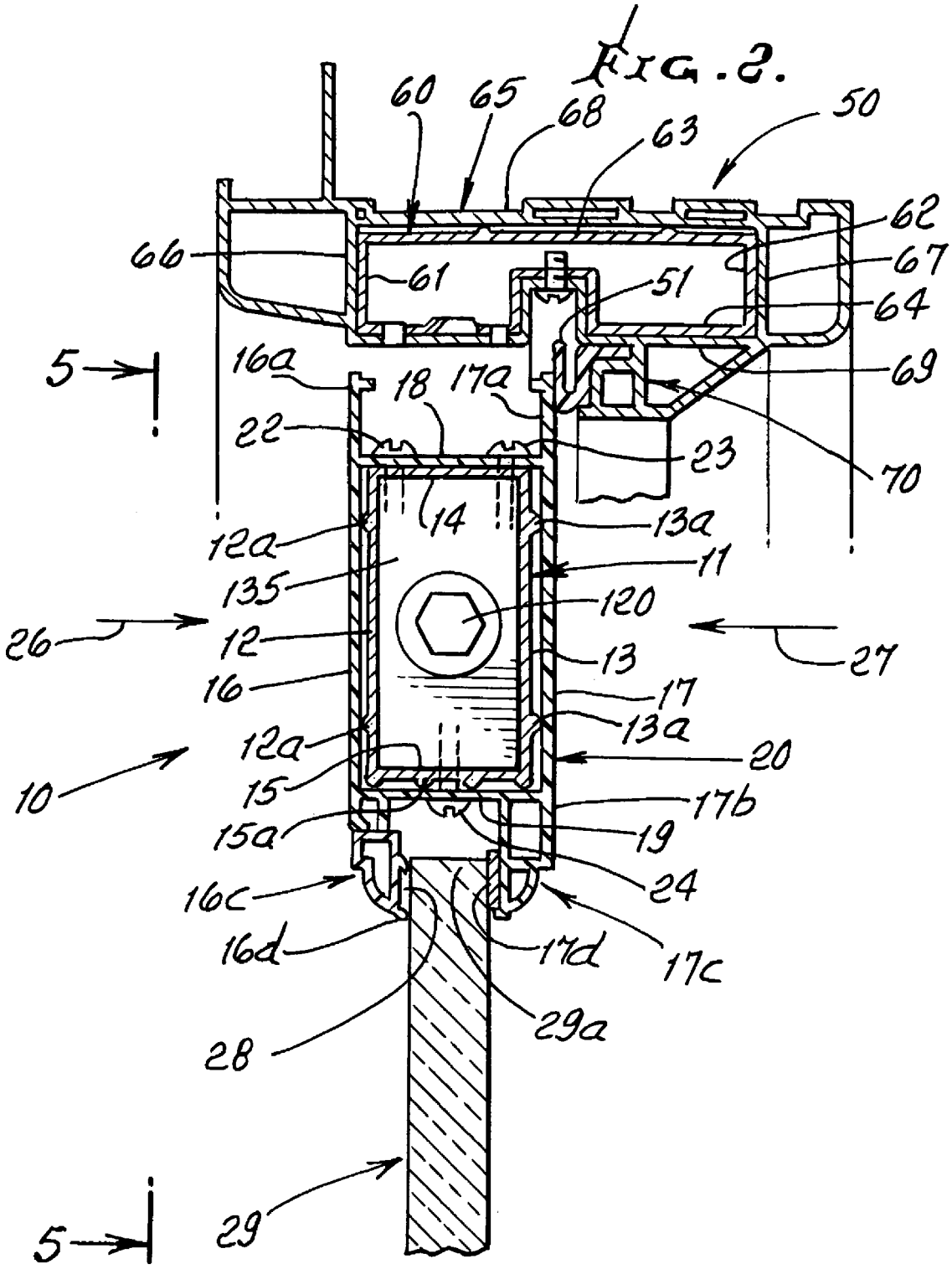
FIG. 2 is an enlarged vertical section taken on lines 2-2 of FIG. 1.
Figure 4:
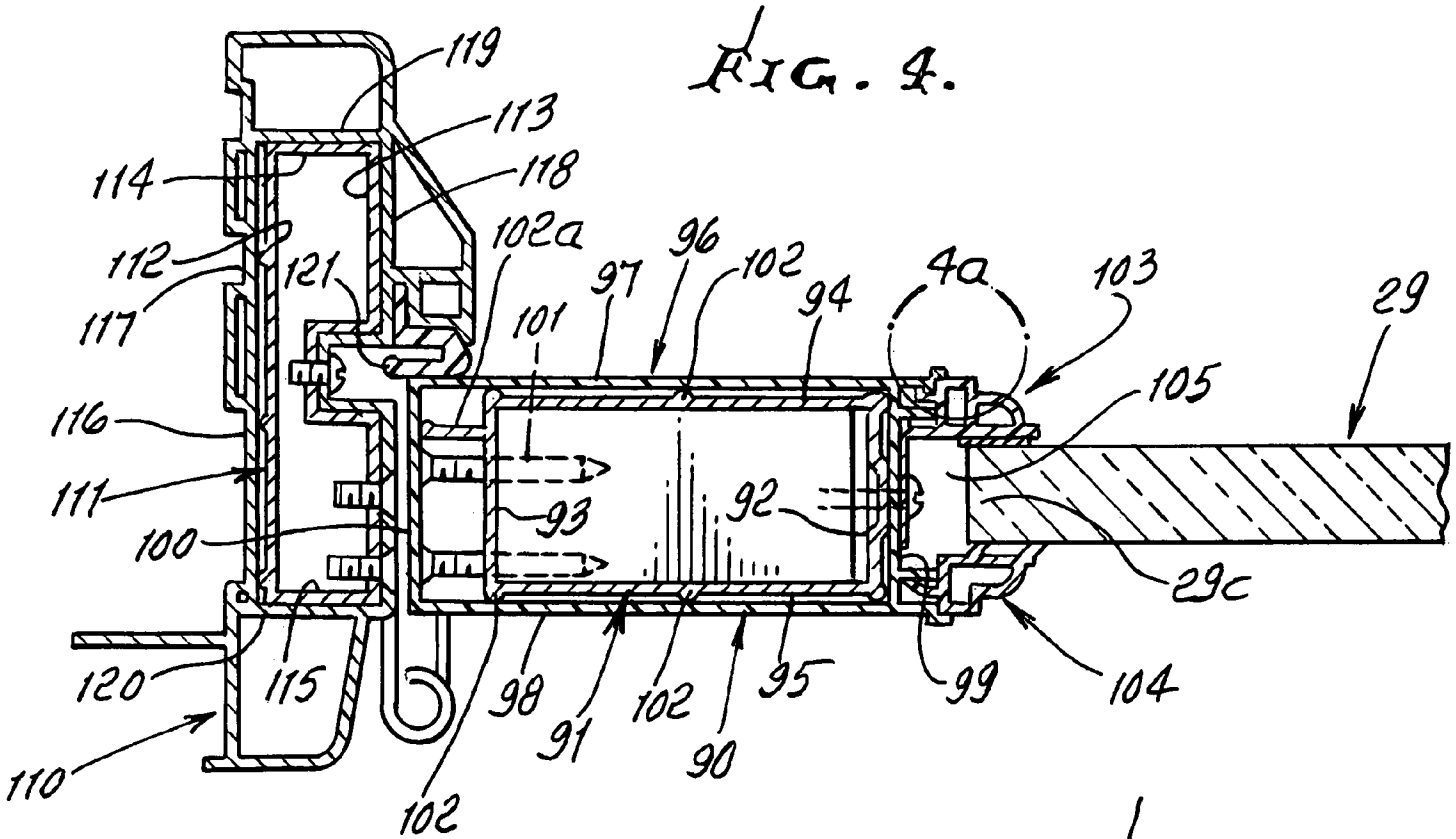
FIG. 4 is an enlarged horizontal section taken on lines 4-4 of FIG. 1.
Figure 4A:
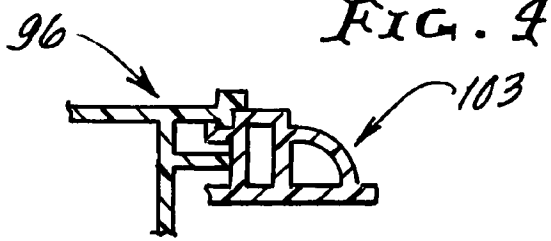
Figure 5:
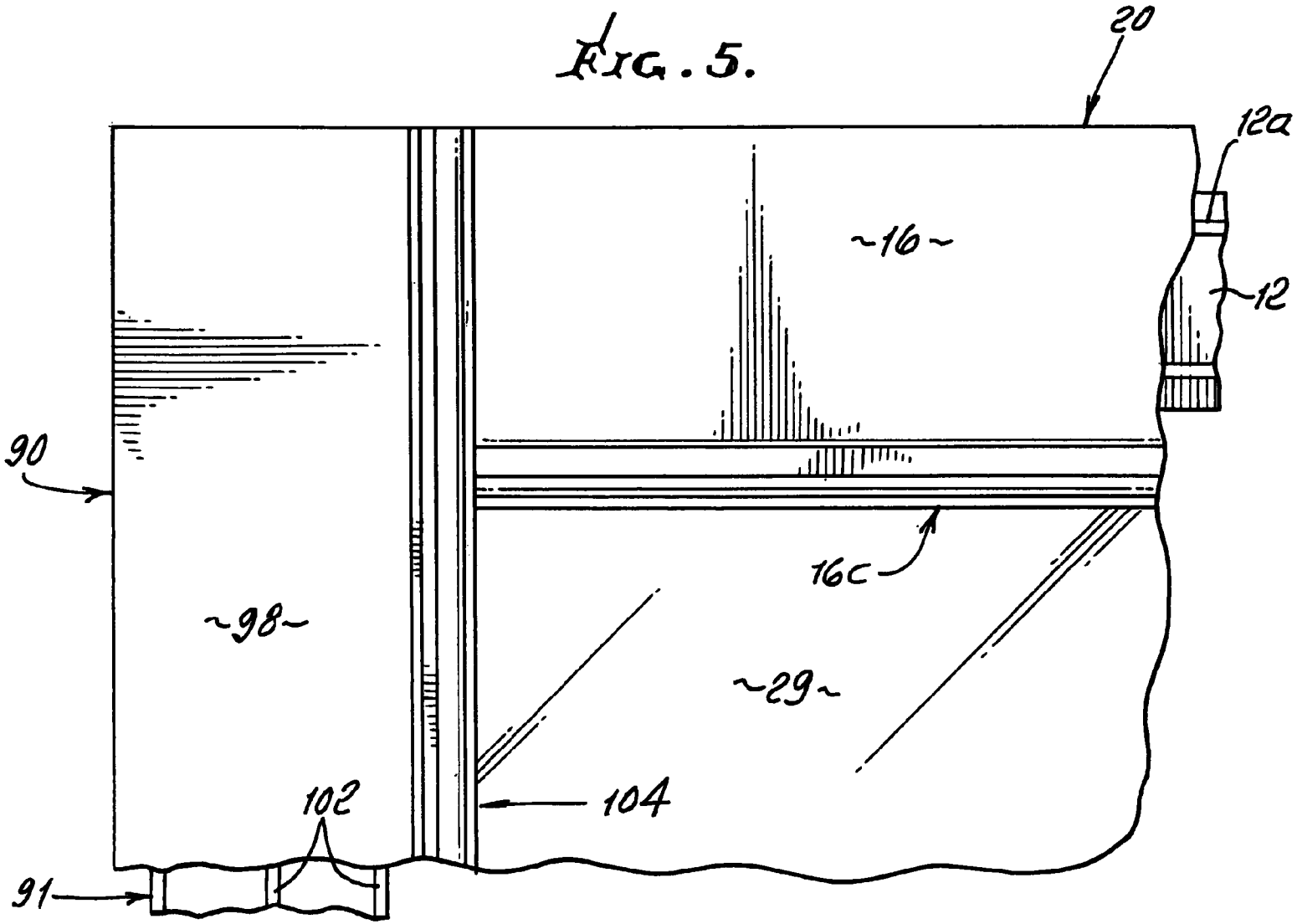
Figure 6:
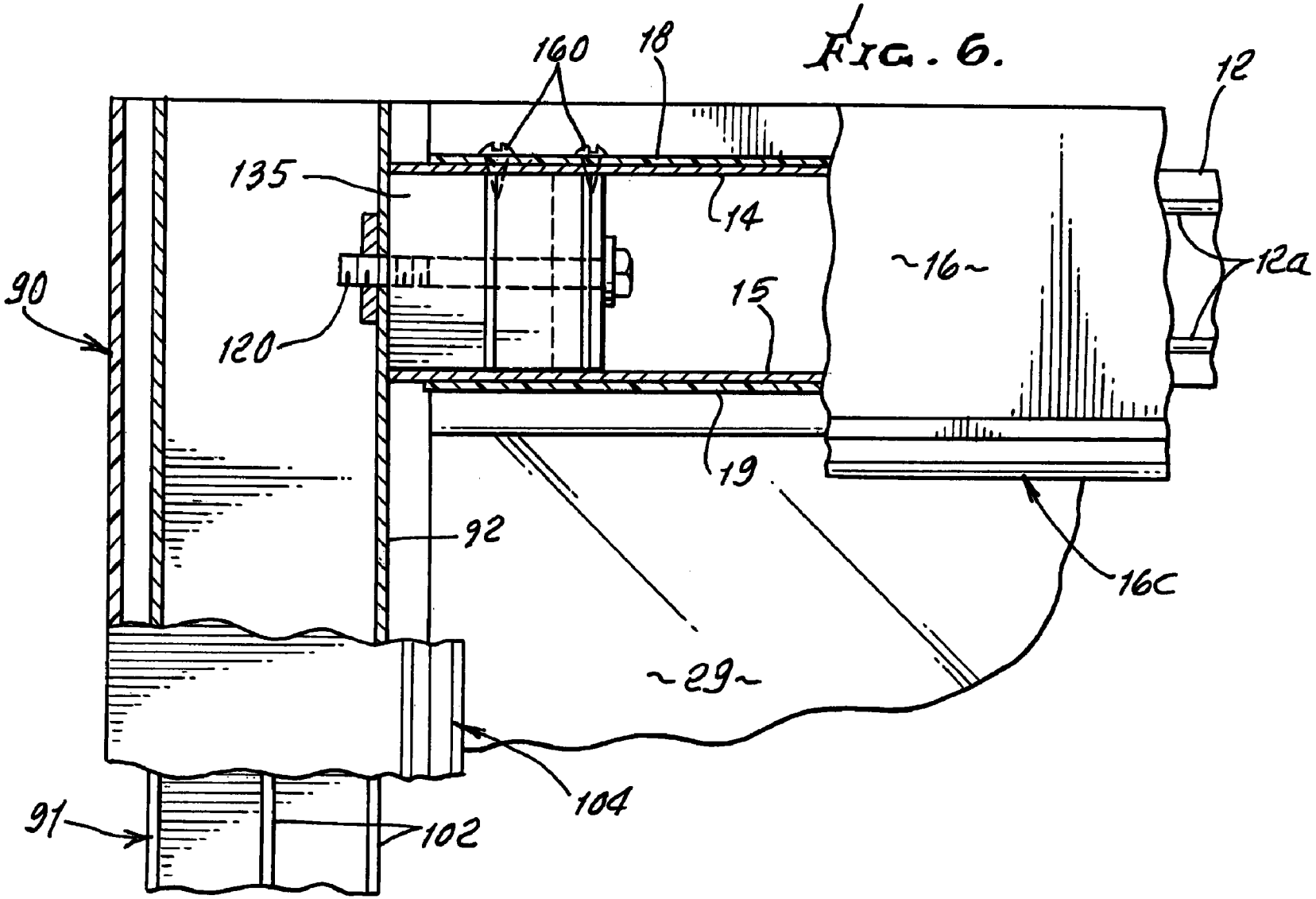
Figure 7:
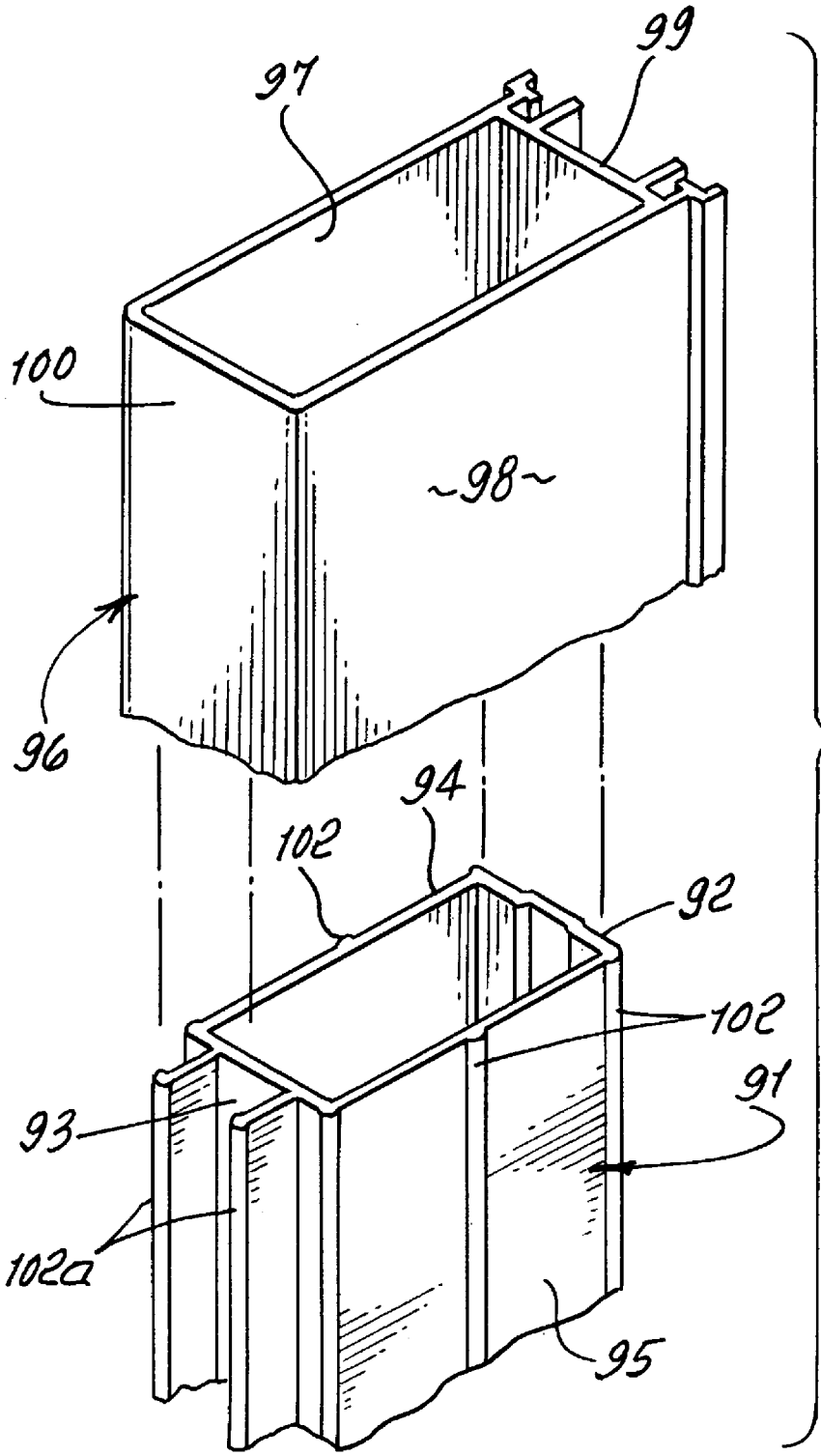

FIG. 4*a* is a cut-away view on lines 4*a*-4*a* of FIG. 4;

FIG. 5 is a fragmentary side elevation taken on lines 5-5 of FIG. 2;

FIG. 6 is a view like FIG. 5, but partly broken away to show interior detail; and FIG. 7 is a perspective view showing slide on assembly of a plastic extrusion onto a metallic frame component.

DETAILED DESCRIPTION

In general, the preferred form of the invention, as shown in the drawings, includes a) a metallic door frame, having opposite sides, b) plastic paneling received on the frame in covering relation with at least one of such sides, c) the plastic paneling including sections having abutting edges.

FIG. 2 shows a door 10 having a horizontal upper metallic frame member or rail 11, in cross-section. Member 11 may be rectangular in cross-section, and have front and rear side walls 12 and 13, and upper and lower walls 14 and 15. Plastic paneling received on the metallic frame member 11 is shown in rectangular cross-section to include front and rear side walls 16 and 17, and upper and lower walls 18 and 19. The plastic paneling may be formed as a shell-like extrusion 20 sized for lengthwise slide-on assembly to the rail 11.

Certain of the metallic frame member walls may typically have outward projections extending lengthwise of such walls, as for example at 12*a*, 13*a* and 15*a* on walls 12, 13 and 15. Those projections are adapted to have local outer tip low friction guide engagement with the inner sides of plastic extrusion walls, and such as walls 16, 17, and 19, as shown, to facilitate lengthwise slide-on assembly or reception of the plastic paneling extrusion 20 onto the metallic upper frame member, or rail 11. Also shown in FIG. 2 are fasteners 22-24 attaching the upper metallic and plastic walls 14 and 18, and walls 15 and 19, after assembly, the fasteners being concealed from view in directions indicated by arrows 26 and 27. Concealment is enhanced by plastic extrusion wall upper and lower extensions 16*a*, 16*b*, 17*a* and 17*b*. Additional plastic extrusion structure 16*c* and 17*c* projecting downwardly forms a channel 28 to receive the upper edge 29*a* of door glass panel 29, with seals 16*d* and 17*d*.

Figure 3:
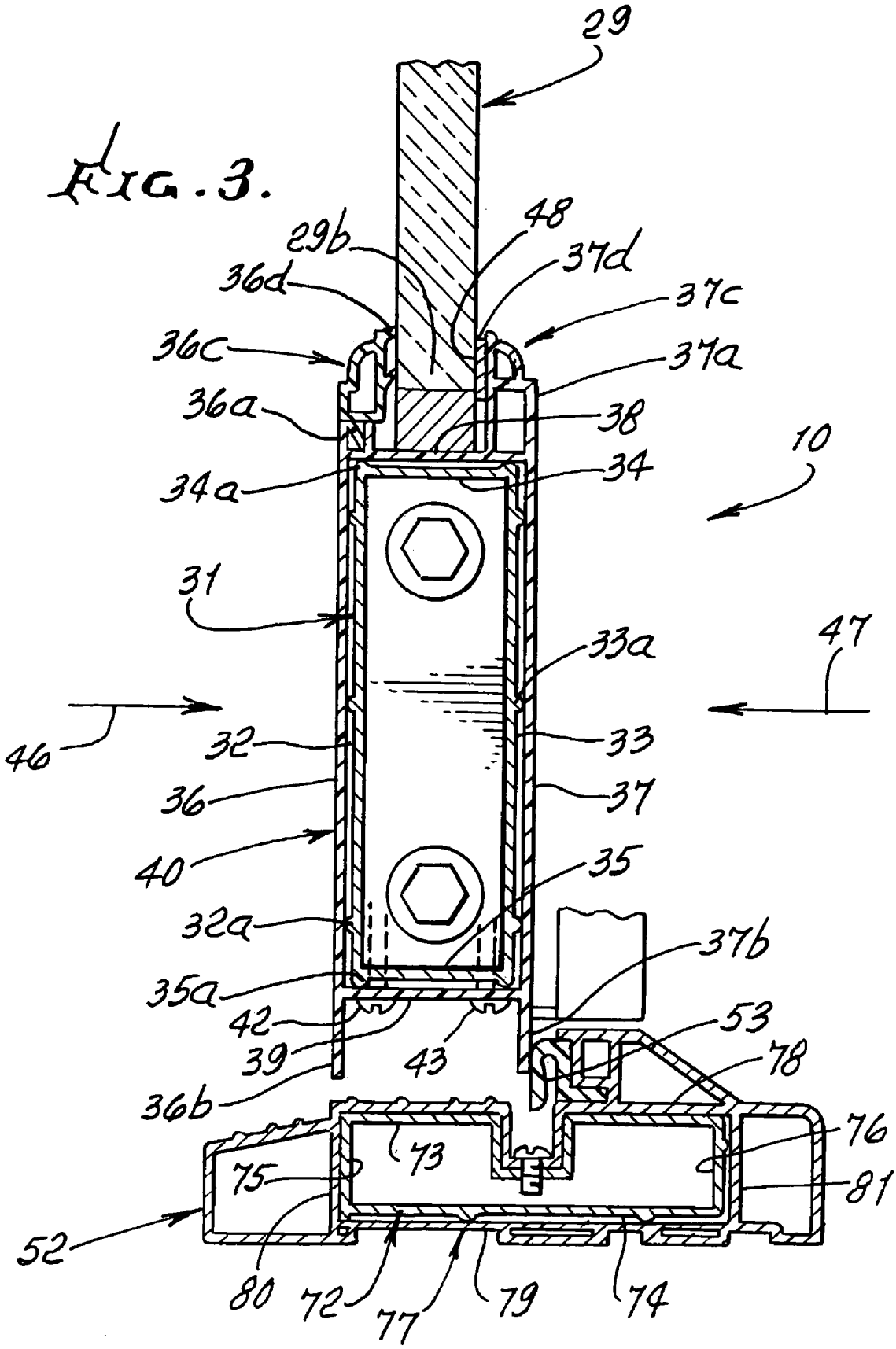
FIG. 3 is an enlarged vertical section taken on lines 3-3 of FIG. 1.

FIG. 3 similarly shows door 10 as having a horizontal lower metallic frame member or rail 31, in cross-section. Member 31 may be rectangular in cross-section to include front and rear walls 32 and 33, and upper and lower walls 34 and 35. Plastic paneling is received on the metallic frame member 31, as is seen in rectangular shell-like cross-section, to include front and rear side walls 36 and 37, and upper and lower walls 38 and 39. The plastic paneling may be formed as an extrusion 40, sized for lengthwise assembly onto the rail 31.

Certain of the metallic frame member walls may typically have like outward projections extending lengthwise of such walls, as for example projections 32*a*-35*a* on walls 32-35. Those projections are adapted to have local, outer tip, low friction, slide-guiding engagement with the inner sides of plastic extrusion walls, such as walls 36-39, as shown, to facilitate ease of lengthwise slide-on assembly or reception of the plastic paneling extrusion 40 onto the metallic lower frame member, or rail 31. Also shown in FIG. 3 are fasteners 42 and 43 attaching the lower metallic and plastic walls 35 and 39 after slide-on assembly, the fasteners being concealed from view in directions indicated by front side and rear side arrows 46 and 47. Concealment is enhanced by plastic extrusion wall upper and lower extensions 36*a* and 36*b*, and 37*a* and 37*b*. Additional plastic extrusion structure 36*c* and 37*c* forms a channel 48 to receive the lower edge 29*b* of door glass panel 29, with seals 36*d* and 37*d*. See also glass panel support 75, within channel 48.

FIG. 2 also shows a doorway frame structure 50 extending horizontally above extrusion 20, with a sealing lip 51 to be engaged by said extrusion extension 17*a*. FIG. 3 shows a doorway threshold frame structure 52 projecting horizontally below lower extrusion 40, in door closed position, with a sealing lip 53 to be engaged by said extrusion extension 37*b*.

Figure 1:
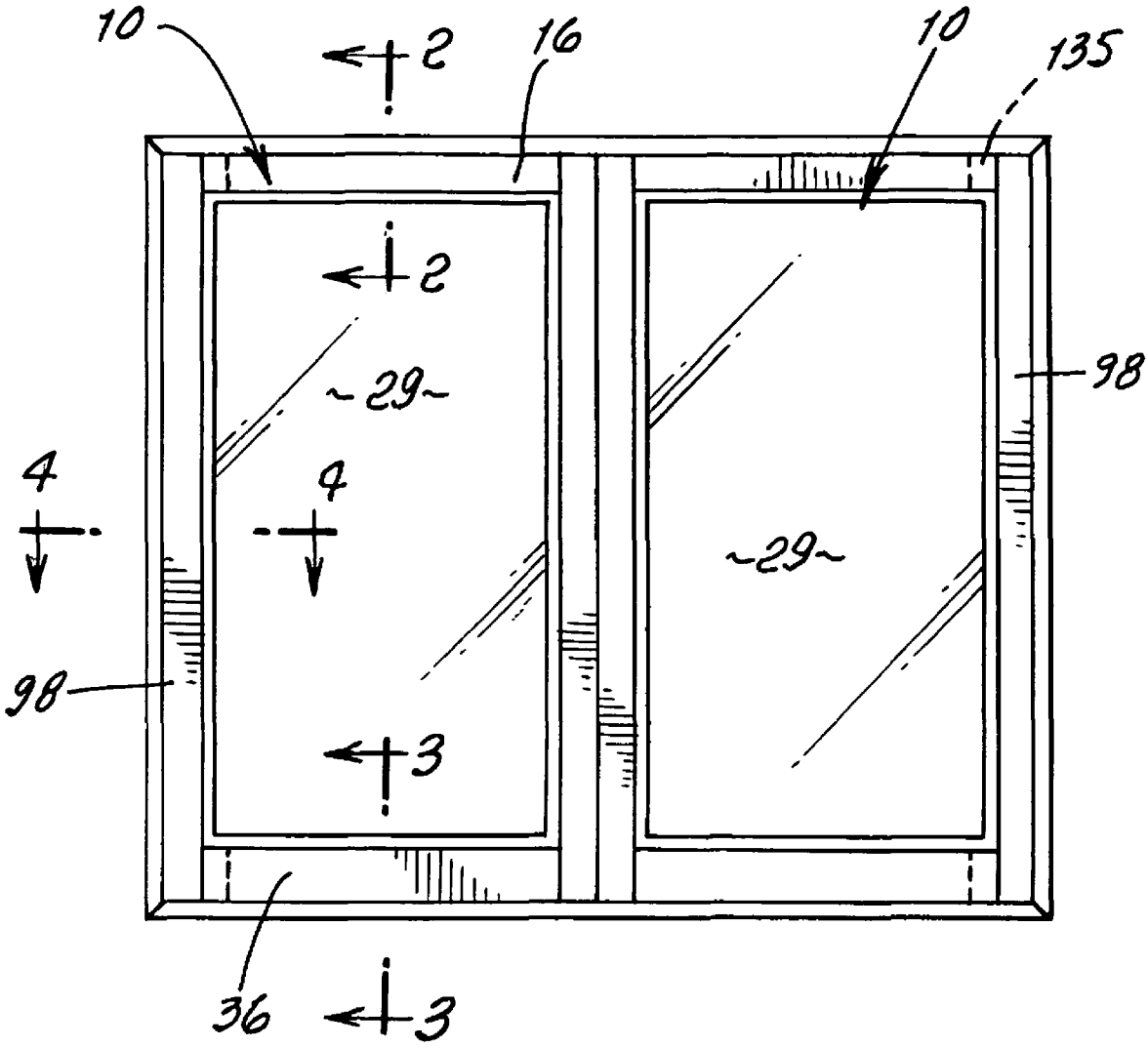
FIG. 1 is a frontal elevation showing a doorway incorporating the invention.

Outer frame structure 50 in FIG. 2 includes an inner metallic extrusion 60 having four walls or panels 61-64, and an outer plastic extrusion 65 having four walls or panels 66-69 extending about 60. Lip 51 suspension structure 70 is integral with wall 69. Structure 52 in FIG. 3 includes an inner metallic extrusion 72 having four walls 73-76, and outer extrusion 77 having four walls 78-81 extending about 72. Lip 52 support structure 82 is integral with wall 78. Projections 86 and 87 on the metallic extrusion walls facilitate low-friction engagement with, and sliding of, the outer plastic extrusion onto the metallic extrusions, in FIGS. 2 and 3. Extrusions 65 and 77 may consist of plastic material, so as to match in texture and color the plastic extrusions 20 and 40 of the door, which is suitably hinged to swing between open and shut positions. All plastic material may consist of PVC (polyvinylchloride), and the metallic elements may consist of aluminum, or other lightweight metal or alloy. FIG. 1 shows the installed door structure.

The door also includes upright stile components, one of which is seen at 90, in FIG. 4, structure at left and right sides of the door being the same. Like the rail components of FIGS. 2 and 3, it includes an inner upright metallic extrusion 91 having walls 92-95, and an outer upright, slide-on plastic extrusion 96 having four walls or panels 97-100. Interconnecting fasteners are seen at 101. Projections on walls of 91 facilitate low friction slide-on engagement with inner sides of walls of 96. See projections 102 and 102*a*. See also FIG. 7. Extruded plastic structures at 103 and 104, attached to extrusion 96, as also seen in FIG. 4*a*, form a recess or channel 105 to receive lateral upright edge 29*c* of glass window 29.

Outer frame upright structure 110 includes an inner metallic extrusion 111 with four walls 112-115; and outer plastic extrusion 116 includes four walls 117-120 with slide-on assembly onto 111. Lip 121 carried by 118 engages wall or plastic panel 96 of the door.

FIGS. 5 and 6 show edge abutting at 104 of plastic panel sections on the rail and stile components, as for example where plastic panels, such as 36 and 98, meet at four corners of the door. Such abutting may for example be formed by edge overlap of panels 36 and 98, or by tongue and groove interfit. The overlap may be provided at all four corners of the door, and at both inner and outer sides of the door. Such abutting is established when the plastic rail and stile extrusion are assembled into place, endwise, on the metallic extrusions, which act to provide door reinforcement, and plastic extrusion support, to prevent sagging of the thin plastic material. Wall thickness of the plastic paneling is typically between about ⅛ inch and ¼ inch.

FIG. 6 shows a metallic fastener 120 connecting a vertical metallic extrusion with a horizontal metallic extrusion. Corner metallic internal blocks, for rigidity, appear as at 135 in FIG. 2, and fasteners 120 connect such blocks to metallic frame structure. Screws 125 are fastened with pre-loading into shear block 135, holding the plastic sheath or extrusion to the metal extrusion 91.

In FIGS. 2-4 the walls of both the metallic and plastic extrusions are relatively thin. For example, the spacing between opposite walls of each rectangular cross-section extrusion is at least five times the thickness of each such wall. The local protuberances on the walls of the metallic extrusion act to hold the metallic and plastic walls in predetermined spaced relation, for low-friction interfit during assembly. The protuberances are spaced apart to support the plastic walls against inward deflections at and near protuberance locations.

All aluminum rails touch the adjacent stiles. The plastic material does not get sandwiched between the structural metallic members.

In FIG. 6, screws 160 are pre-loaded into the shear block or blocks, at corners, to assume a tight joint or joints. The screws pass through both plastic and metallic members, and into the shear block, as shown.

I claim:

1. A door structure, comprising a) a metallic door frame, having opposite sides, b) plastic paneling received on the metallic frame in covering relation with at least one of said sides, c) there being two spaced apart stile components extending vertically and at least one rail component having edges abutting edges of said stile components, d) said plastic paneling defining rail and stile door components, and said metallic frame including rail and stile door components, e) the plastic paneling stile components extending closely and completely about the metal frame stile components, and the plastic paneling rail components extending closely and completely about the metal frame rail components, f) the plastic paneling stile components defined by first plastic extrusions slidably and guidedly received onto the metal frame stile components, and the plastic paneling rail components defined by a second plastic extrusion slidably and guidedly received onto the metal frame rail components, there being outwardly tapering protrusions projecting normal to flat side walls defined by the metal frame stile, and rail components into open spaces between the side walls of plastic and metal extrusions and toward plastic wall surfaces for acting as guides for said sliding for close interfitting, the protrusions projecting from at least three sides and spaced from the corners of the stile and rail components, one side of the walls of both the plastic and the metal extrusions being slidingly engaged without protrusions, g) there being threaded fasteners directly holding the second plastic extrusions endwise to the metal frame rail components.

2. The structure of claim 1 wherein said plastic consists of PVC.

3. The structure of claim 1 wherein there are two spaced apart stile components extending vertically and at least one rail component having edges abutting edges of said stile components.

4. The structure of claim 1 wherein the plastic paneling stile components overlap the metal frame stile components, and a plastic paneling rail component overlaps a metal frame rail component.

5. The structure of claim 1 wherein said second plastic extrusion has opposite end edges extending in abutting relation to lengthwise elongated edges of the first plastic extrusions.

6. The structure of claim 3 wherein said abutting edges are defined by interfitting tongue and groove elements, or by edge overlapping elements.

7. The structure of claim 5 wherein said abutting edges are defined by interfitting tongue and groove elements.

8. The structure of claim 5 including a threaded fastener or fasteners also acting to hold said second plastic extrusion in edge abutting relation to said first plastic extrusion.

9. The structure of claim 1 wherein said metallic door frame has a rectangular cross-section with four walls, certain of said walls having outward projections extending lengthwise of the certain walls, the plastic paneling locally engaging said projections which are adapted to facilitate slide-on reception of the plastic paneling onto the metallic frame.

10. The structure of claim 9 wherein the plastic paneling is formed by extrusions having extensions forming a recess or recesses to receive door glazing.

11. The structure of claim 1 including e) said one metallic extrusion having multiple walls, f) said plastic paneling forming an elongated plastic extrusion having multiple walls and sized for relative endwise assembly onto the one metallic extrusion, g) and guide means on certain of said metallic extrusion walls to slidably and locally engage walls of the plastic extrusion to thereby ease relative endwise assembly.

12. The combination of claim 11 wherein each of said extrusions has four walls defining a substantially rectangular cross section, the plastic extrusion fitting about the metallic extrusion.

13. The combination of claim 11 wherein said guide means comprises local protuberances integral with said certain metallic extrusion walls, the walls of both extrusions being relatively thin.

14. The combination of claim 11 wherein there are multiple of said metallic extrusion portions of which are interengaged, and without intervening plastic extrusion material.

15. The combination of claim 1 including a shear block at a corner formed by said end and side, and a fastener extending through a metallic extrusion wall, and into the shear block, plastic paneling surrounding said block and said head defined by said threaded member.

16. The structure of claim 1, including c) said one metallic extrusion having multiple walls, d) said plastic paneling forming an elongated plastic extrusion having multiple walls and sized for relative endwise assembly onto the one metallic extrusion, e) and said protrusion providing guide means on certain of said metallic extrusion walls to slidably and locally engage walls of the plastic extrusion to thereby ease relative endwise assembly.

17. The structure of claim 16, wherein each of said extrusions has four walls defining a substantially rectangular cross section, the plastic extrusion fitting completely about the metallic extrusion.

18. The structure of claim 16 wherein said guide means comprises local protuberances integral with said certain metallic extrusion walls, the walls of both extrusions being relatively thin.

* * * * *